United States Patent [19]

Yamasaki et al.

[11] 4,222,355

[45] Sep. 16, 1980

[54] EXHAUST GAS RECIRCULATION APPARATUS FOR AN INTERNAL COMBUSTION ENGINE

[75] Inventors: Tatsumi Yamasaki; Isamu Ota; Yutaka Hasegawa; Heisuke Yamamoto, all of Toyota; Noriaki Kawai, Okazaki; Toshihito Abe, Kariya, all of Japan

[73] Assignees: Toyota Jidosha Kogyo Kabushiki Kaisha, Toyota; Nippondenso Kabushiki Kaisha, Kariya, both of Japan

[21] Appl. No.: 958,722

[22] Filed: Nov. 8, 1978

[30] Foreign Application Priority Data

Jun. 30, 1978 [JP] Japan ..... 53-78575

[51] Int. Cl.[3] ..... F02M 25/06

[52] U.S. Cl. ..... 123/568

[58] Field of Search ..... 123/119 A

[56] References Cited

U.S. PATENT DOCUMENTS

| | | | |
|---|---|---|---|
| 4,041,917 | 8/1977 | Suzuki | 123/119 A |
| 4,092,960 | 6/1978 | Nohira et al. | 123/119 A |
| 4,128,090 | 12/1978 | Aoyama | 123/119 A |
| 4,137,874 | 2/1979 | Otsubo et al. | 123/119 A |
| 4,149,503 | 4/1979 | Ozaki et al. | 123/119 A |
| 4,150,649 | 4/1979 | Gropp | 123/119 A |

*Primary Examiner*—Wendell E. Burns

*Attorney, Agent, or Firm*—Kenyon & Kenyon

[57] ABSTRACT

Disclosed herein is an internal combustion engine provided with an exhaust gas recirculation system of so-called back pressure control type. The exhaust gas recirculation system is provided with a vacuum line connecting a so-called EGR port with a vacuum operated flow control valve, and a modulator valve having a control chamber selectively opened to the vacuum line in response to the pressure of recirculated exhaust gas for controlling vacuum signal level of the flow control valve. The control chamber of the modulator is connected to another vacuum signal port located slightly above the EGR port.

7 Claims, 17 Drawing Figures

EXHAUST GAS RECIRCULATION APPARATUS FOR AN INTERNAL COMBUSTION ENGINE

FIELD OF THE INVENTION

The present invention relates to an improvement of a so-called back pressure control type EGR system for an internal combustion engine.

BACKGROUND OF THE INVENTION

A back pressure control type EGR system is provided with a vacuum-operated flow control valve located on a recirculation passageway connecting an exhaust manifold of the engine with an intake manifold of the engine, and a vacuum modulator valve having a control chamber normally opened to the atmosphere. The control chamber is, in response to the pressure of the exhaust gas in a small space formed in the recirculation passageway, opened to a vacuum line connecting the flow control chamber with an EGR port formed in an intake passageway of the engine. This system makes it possible to maintain a predetermined constant pressure of the exhaust gas in the constant pressure space, which pressure is near atmospheric air pressure, as is well known to those skilled in this art. Thus, a predetermined constant ratio of the amount of the recirculated exhaust gas to the total amount of fluid directed to the engine combustion chamber (so-called EGR ratio) is obtained at every throttle opening or load of the engine.

The prior art back pressure control type EGR system has, however, a drawback in that an adverse effect, such as "surging", easily takes place under a low load condition of the engine, when a large amount of exhaust gas is recirculated for effectively decreasing the amount of $NO_x$ components in the exhaust gas. This is because a maximum value of the EGR ratio where the surging does not occur is low when the load of the engine is small, while the actual EGR ratio is, irrespective of the load of the engine, maintained at a predetermined value as already described.

SUMMARY OF THE INVENTION

An object of the present invention is to provide an improved construction of a back pressure control type EGR system capable of controlling the EGR ratio in accordance with the load of the engine.

Another object of the present invention is to provide a back pressure control type EGR system capable of recirculating a large amount of exhaust gas while preventing the occurrence of "surging".

The above mentioned objects of the present invention are attained by a back pressure control type EGR system according to the present invention, in which a control chamber of a modulator valve, which is opened to a vacuum line connecting an EGR port with an EGR valve in accordance with the pressure of the recirculated exhaust gas in a constant pressure space, is connected to another port located slightly above the EGR port. From the other port, a vacuum signal with a vacuum level which is changed in accordance with the load of the engine is introduced into the modulator, which make it possible to control the EGR ratio in accordance with the load of the engine.

BRIEF DESCRIPTION OF THE APPENDED DRAWINGS

FIGS. 7-1 through 7-4 show other various EGR characteristic curves obtained by the system in FIG. 6A.

FIGS. 9-1 through 9-4 are various EGR characteristic curves obtained by the system illustrated in FIG. 8.

DETAILED DESCRIPTION OF PREFERRED EMBODIMENTS

Figure 1:
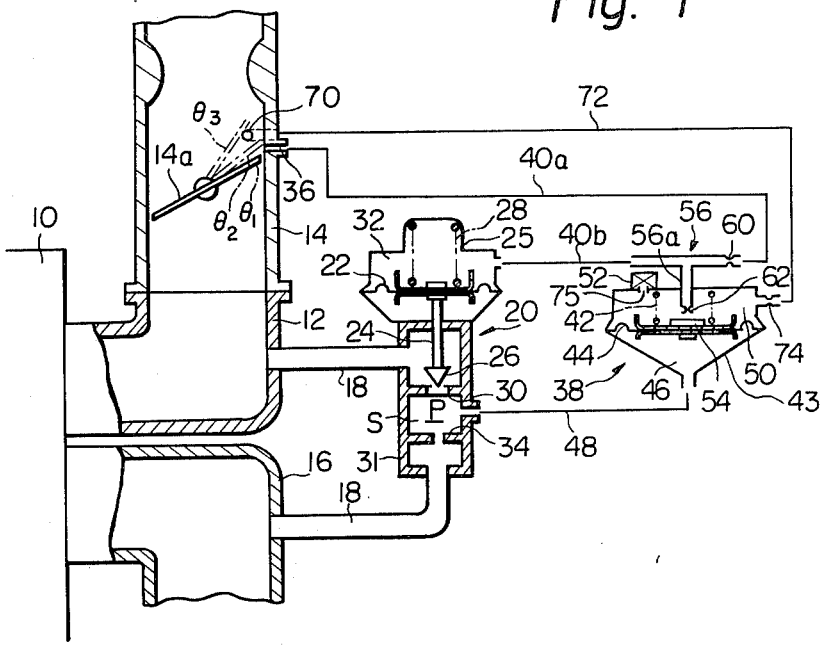
FIG. 1 is a diagrammatic view of an internal combustion engine provided with a back pressure control type EGR system of the present invention.

Referring to FIG. 1 which illustrates an embodiment of the present invention, an internal combustion engine comprises an engine body 10, an intake manifold 12 connected to combustion chambers (not shown) in the engine body 10, a carburetor 14 connected to the intake manifold 12 for generating a flow of intake air directed to the combustion chambers, and an exhaust manifold 16 connected to the combustion chambers for receiving resultant exhaust gas therefrom. The reference numeral 18 designates an exhaust gas recirculation (EGR) passageway connecting the exhaust manifold 16 with the intake manifold 12. A flow control valve 20 is adapted for controlling the amount of recirculated exhaust gas passing through the EGR passageway 18 to the intake manifold 12. The flow control valve 20 is of a vacuum operated type and is comprised of a diaphragm 22, a valve rod 24 having one end connected to the diaphragm 22 arranged across the interior of a diaphragm casing 25, and a valve member 26 connected to the other end of the valve rod 24. The flow control valve 20 further comprises a spring 28 and a valve seat 30 formed in a valve casing 31. The spring 28 urges the diaphragm 22 so that the valve member 26 is moved toward the valve seat 34. A vacuum chamber 32 is formed above the diaphragm 22, so that vacuum pressure in the chamber 32 can control the opening between the valve member 26 and the valve seat 30, in order to control the amount of recirculated exhaust gas.

A back pressure control throttle 34 is located slightly below or upstream of the valve seat 30 for restricting the flow area of recirculated exhaust gas directed to the valve seat 30. Therefore, a constant pressure chamber S of relatively small volume is formed between the valve seat 30 and the throttle 34.

A reference numeral 36 is a vacuum signal port (so-called EGR port) formed in the carburetor barrel at a position located slightly above the throttle valve 14*a* when the throttle valve 14*a* is in its idle condition. The vacuum actuated flow control valve 20 is operated by vacuum pressure at the EGR port 36 as will be fully described later.

A back pressure control type EGR system of the present invention is provided with, in addition to the flow control valve 20, a modulator valve 38 for controlling the level of the vacuum in the chamber 38 of the valve 20 in accordance with the positive pressure of the recirculated exhaust gas in the constant pressure chamber S. The modulator valve 38 is provided with a diaphragm 44 arranged across the interior of a casing 43. A spring 42 urges the diaphragm 44 so that it moves downwardly. A back pressure chamber 46 is formed on one side of the diaphragm 44 opposite to the spring 42, which chamber 46 is connected to the constant pressure space S by means of an exhaust gas pressure conduit 48. An air chamber 50, in which the spring 42 is arranged, is opened to the atmosphere through a filter element 52. A valve member 54 is fixed to the diaphragm 44 at the middle portion thereof. The reference numeral 56 designates a vacuum control pipe located between a vacuum conduit 40*a* connected to the EGR port 36 and another vacuum conduit 40*b* connected to the chamber 32, and has a branch portion 50*a* having an open end at the bottom thereof, which end faces the valve plate 54. The pipe 56 is provided with a first flow control orifice 60 and a second flow control orifice 62.

In addition to the above-mentioned parts, which are also provided in a conventional back pressure EGR system, the present invention is further provided with means for effecting the control of EGR ratio in accordance with the load of the engine. As shown in FIG. 1, a second vacuum signal port 70 is formed in the carburetor at a position slightly above the EGR port 36, for generating a vacuum signal with a level which changes in accordance with the load of the engine. The second vacuum port 70 is connected to the air chamber 50 of the vacuum modulator valve 38 by means of vacuum conduit 72. A third orifice 74 is formed in the vacuum conduit 72 for controlling the flow of the vacuum signal flow the port 70 to the chamber 50. A fourth orifice 75 is arranged between the air chamber 50 and the air filter 52 for controlling the flow of the air introduced into the chamber 50 from the air filter 52.

The back pressure control EGR system of the present invention, wherein the second vacuum port 70 located above the EGR port 36 is connected to the air chamber 50 of the modulator valve 38, operates in the following manner.

IDLE CONDITION

When the engine is operating in an idle condition (the throttle opening in $\theta_1$ degree), the EGR port 36 is located above the throttle valve 14*a*. Therefore, the vacuum chamber 32 connected to the EGR port 36 is under a pressure which is close to atmospheric pressure. Thus, the spring 25 urges the valve member 26 so that the valve member 26 is seated on the valve seat 30, causing the EGR passageway 18 to close. As a result, EGR operation is not carried out.

LOW LOAD CONDITION

When the throttle opening is in a range between $\theta_1$ to $\theta_2$, the engine is operating in a low load condition. In this case, the throttle valve 14*a* is located above the EGR port 36 and is located below the second vacuum port 70. As a result, the second port 70 is under a pressure which is close to atmospheric pressure, but the EGR port 36 is under a vacuum pressure. The vacuum level at the EGR port 36 decreases in accordance with the increase of throttle opening, as shown by a curve p in FIG. 2A. The vacuum signal at the EGR port 36 is transmitted into the modulator valve 38 via the vacuum conduit 12*a* and is introduced into the EGR valve 20 via the vacuum conduit 40*b*, in order to generate a vacuum force in the diaphragm 22. This causes the valve member 26 to move away from the valve seat 30 against the force of the spring 28. As a result, the exhaust gas in the constant pressure space S is directed to the intake manifold 12.

When a pressure P in the constant pressure space S connected to the modulator chamber 50 is low enough to cause the diaphragm 44 to displace downwardly by the force of spring 42, the valve member 43 is detached from the open end of the pipe portion 56*a* so that a fluid communication is provided between the vacuum line connecting the EGR port 36 with the EGR valve 20 and the air chamber 50 which is under atmospheric pressure, since the air introduced into the chamber 50 not only through the orifice 75 but also through the orifice 74 connected to the port 70 located above the EGR port. Therefore, the vacuum level in the vacuum chamber 32 of the EGR valve 20 decreases, so that the valve member 26 moves downwardly toward the valve seat 30 so as to increase the pressure P in the space S. When the pressure in the chamber 46 connected to the space S is high enough to cause the diaphragm 44 to move upwardly, against the force of spring 42, the valve member 44 is rested on the open end of the pipe portion 56*a* and interrupts the vacuum line from the air chamber 50. As a result, the vacuum level in the vacuum chamber 32 of the flow control valve 20 increases and causes the valve member 26 to move upwardly away from the valve seat 30, so that the pressure P decreases. Thus, in this low load condition wherein the throttle opening is $\theta_1$–$\theta_2$, the vacuum level in the chamber 32 of the EGR valve is substantially maintained at a constant value, as shown by a curve $q_1$ in FIG. 2A, even if the vacuum level at the EGR port 36 is, in accordance with the change of the throttle opening, changed as shown by the curve p in FIG. 2A. Thus, the pressure P of the exhaust gas in the space is substantially maintained at atmospheric pressure. The constant pressure which is close to atmospheric pressure in the space S makes it possible to maintain a constant ratio of the amount of the recirculated exhaust gas introduced into the intake manifold 12 to the amount of the total fluid introduced to the engine body 10 (FGB ratio). This is well known to those skilled on this art and is illustrated by the curve $A_1$, in FIG. 3, which shows the relation between the load of the engine (opening of the throttle valve 14*a*) and the EGR ratio. The constant value $k_1$ of the EGR ratio of the curve $A_1$ is suitably determined by appropriately selecting the inner diameter of the valve seat 30 and the throttle 34, as well as the dimensions of the orifices 60, 74 and 75. In FIG. 3, the curve B indicates a maximum EGR ratio at every throttle opening where "surging" does not take place, while the shaded lines indicate a region where "surging" takes place. Thus, the curve A should be as high as possible below the curve B, so that a large amount of the exhaust gas is recirculated for effectively decreasing $NO_x$ emissions from the engine, while preventing the occurrence of "surging".

MIDDLE LOAD CONDITION

Figure 3:
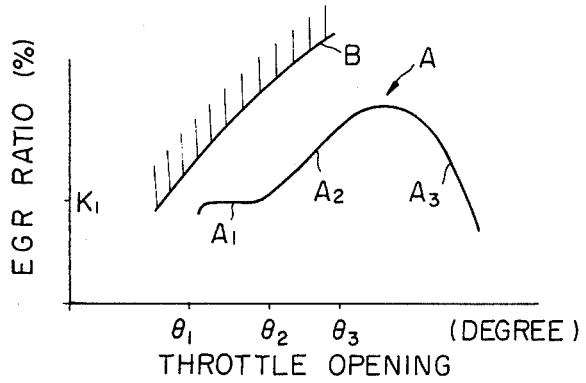
FIG. 3 is graphs showing relations between the throttle opening and the EGR ratio, wherein A indicates a basic EGR characteristic curve of the invention, while the shaded lines indicate a region where "surging" takes place.
Figure 4:
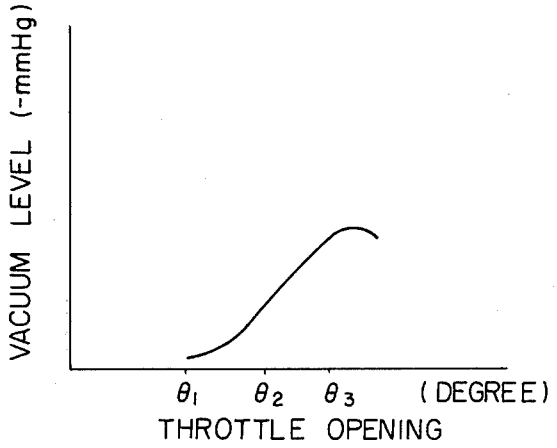
FIG. 4 is a graph showing the relation between the throttle opening and the vacuum level at the port 70.

When the engine is operating in a middle load condition, the throttle opening is smaller than $\theta_3$, wherein the throttle valve 14*a* is located above the second port 70, so that the pressure of the port 70 is a vacuum pressure. Therefore, even if the chamber 50 is opened to the atmosphere via the air filter 52, the chamber 50 is under a vacuum pressure, since the introduction of atmospheric air into the chamber 32 is controlled to a slow rate by the orifice 75. A vacuum pressure in the air chamber 50 causes the diaphragm to be urged upwardly so that the valve member 54 is moved toward the open end of the pipe portion 56*a*. Therefore, the amount of air introduced into the air control pipe 56 from the chamber decreases, so that the vacuum in the vacuum chamber 32 of the EGR valve 20 increases. As a result, the valve member 36 is moved away from the valve seat 30, so that the amount of the recirculated exhaust gas moving via the EGR passageway 18 is increased. Since the vacuum level at the port 70 increases as the throttle opening increases from $\theta_2$ degree to $\theta_3$ degree, as illustrated in FIG. 4, the vacuum level in the air chamber 50 of the vacuum modulator increases as shown by the curve $q_2$ in FIG. 2. Consequently, the vacuum level of the vacuum chamber 32 of the EGR valve, i.e., the EGR ratio, increases in accordance with the increase of the throttle opening from the degree $\theta_2$ to the degree $\theta_3$, as shown by the curve $A_2$ in FIG. 3. Since the throttle opening corresponds to the load of the engine, the control of the EGR ratio in accordance with the load of the engine is effected in the middle load operating condition, wherein the throttle opening is written a range of from $\theta_2$ to $\theta_3$. The inclination of the curve $A_2$ is adjusted by appropriately selecting the dimensions of the third and fourth orifices 74 and 75. If the dimension of the fourth orifice 75 with respect to the dimension of the third orifice 74 is small, the rate of increase of the EGR ratio, i.e., the inclination of the curve portion $A_2$, is large, since the vacuum level in the air chamber 50 of the modulator valve 38 becomes high. If the dimension of the force orifice 75 with respect to the third orifice 74 is large, the inclination of the curve portion $A_2$ will be small.

HIGH LOAD CONDITION

When the throttle opening is larger than $\theta_3$, i.e., when the engine is operating in a high load condition, the vacuum level at the load sensing port 70 is high (FIG. 4) enough to cause the diaphragm 44 to be moved upwardly against the force of the spring 42, so that the valve member 54 is always rested on the open end of the pipe portion 56*a*. Therefore, the air chamber 50 of the modulator valve 38 is always disconnected from the control pipe 56, so that the vacuum modulating function of the valve 38 is stopped. As a result, the EGR ratio is controlled in accordance with the vacuum level at the EGR port 36, which corresponds to the curve P in FIG. 2. Consequently, EGR ratio decreases in accordance with the increase of the throttle opening i.e., the load of the engine as shown by a curve portion $A_3$ in FIG. 3. This curve $A_3$ is substantially the same as the characteristic curve of the so called vacuum control type EGR system.

As will be clear from the above, the control of the EGR ratio is, according to the present invention, effected in accordance with the load of the engine by connecting the modulator valve 38 with the vacuum port 70 located above the EGR port 36. Therefore, a high EGR ratio is obtained during the middle and the high load operating conditions, so that the amount of $NO_x$ emissions is decreased, while a sufficiently low EGR ratio is maintained during the low load operating condition to prevent the occurrence of "surging".

Figure 5:
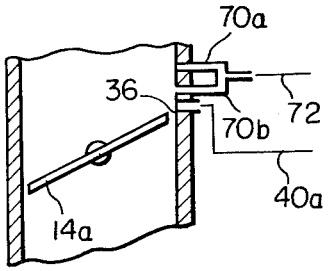
FIG. 5 is a partial view indicating a modification of the embodiment in FIG. 1.

Although the single vacuum port 70 is used in the embodiment illustrated in FIG. 1, a plurality of vacuum ports 70*a* and 70*b*, which are located above the idle position of the throttle valve 14*a*, may be provided in the carburetor as illustrated in FIG. 5. The vacuum ports 70*a* and 70*b* are connected, via a vacuum conduit 72, to a not shown modulator valve which is substantially same as the modulator valve 38 in FIG. 1. In the modification illustrated in FIG. 5, the throttle valve 14*a* firstly engages the port 70*b* and then engages the port 70*a*, when the throttle valve 14*a* is opened from the idle position. Therefore, the vacuum conduit 72 receives vacuum signals from the ports 70*a* and 70*b*, the level of which vacuum signals increases in accordance with the increase of the opening of the throttle valve 14*a* in a similar manner as that described with reference to FIG. 4.

In the system of FIG. 1, the modulator 38 is opened to the atmosphere via the air filter 52, as is also the case in the prior art. However, it should be noted that the filter 52 and, consequently, the fourth orifice 75, can be omitted. In this case, when the throttle opening is smaller than $\theta_2$ the vacuum level in the chamber 32 of the EGR valve may conform to the curve $q_1$ in FIG. 2, since air may be introduced into the chamber 50 from the second port 70. When the throttle opening is larger than $\theta_2$, the vacuum level in the chamber 32 may substantially conform to the curve $q_2$.

Figure 6A:
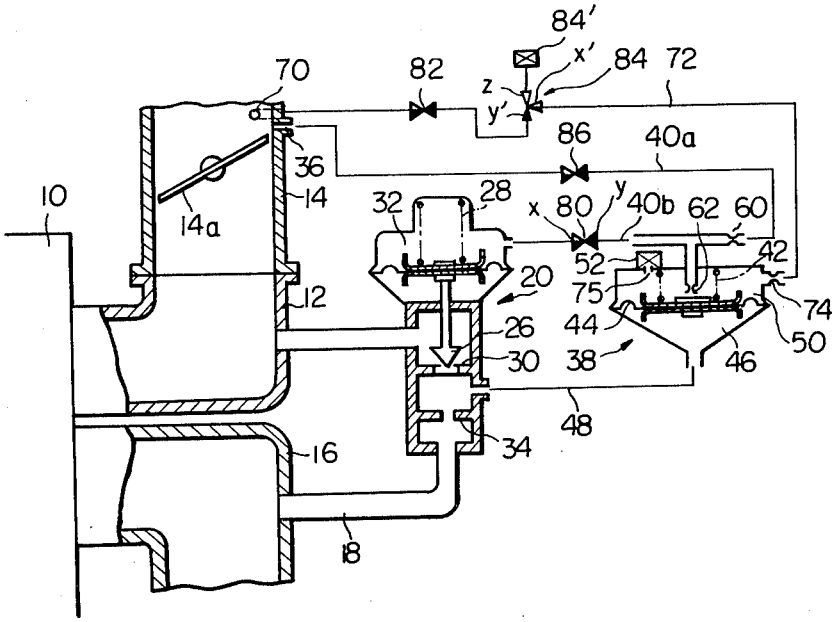
FIG. 6A is another modification of FIG. 1, wherein a plurality of signal switching valves responsive to particular operating parameters of the engine are arranged on vacuum signal lines.

The EGR system illustrated in FIG. 6A has, in addition to the basic components illustrated in FIG. 1, various vacuum switching valves operated by sensing particular operating conditions of the engine. A two-port valve 80 is mounted on the conduit 40*b* connecting the vacuum chamber 32 of the EGR valve 20 to the air chamber 50 of the modulator 38. Another two-port valve 82 is arranged on the conduit 72 connecting the air chamber 50 to the load sensing port 70. On this conduit 72, a third valve 84 which has three ports is mounted. A fourth valve 86 of two port type is mounted on the conduit 40*a* connecting the vacuum control pipe 56 of the modulator 38 to the EGR port 36. The above-mentioned valves 80, 82, 84 and 86 are operated by respective operational parameters of the engine, as illustrated herein-below.

The first valve 80 of two port type may be made responsive to the temperature of the coolant of the engine and is operated as indicated in the following table.

| Temperature of the Coolant | Valve 80 |
|---|---|
| lower than 60° C. | closed |
| higher than 60° C. | open |

In the above table, "closed" means that ports x and y (FIG. 6A) of the valve 80 are disconnected from each other, whereas "open" means that the ports x and y are connected to each other.

The second valve 82 of two port type may be made responsive to the rotational speed of the engine and is operated as indicated in the following table.

| Rotational Speed of the Engine | Valve 82 |
|---|---|
| lower than 1,000 r.p.m. | closed |
| higher than 1,000 r.p.m. | open |

The meaning of "closed" and "open" in the above table is the same as described with regard to the valve 80.

The third valve 84 of three-port type may be made responsive to the speed of vehicle and is operated as indicated in the following table.

| Speed of Vehicle | Valve 84 |
|---|---|
| lower than 80 km/h | "open" |
| higher than 80 km/h | "closed" |

In the above table "open" means that a common port x' of the valve 84 is connected to a port y', while the port x' is disconnected from another port z; "closed" means that the common port x' is disconnected from the port y' while the common port y' is connected to the port z. This port z is connected to the atmosphere via an air filter 84' as illustrated in FIG. 6A.

The fourth valve 86 of two-port type may be made responsive to the vacuum level in the intake system and is operated indicated in the following table.

| Vacuum level in the Intake System | Valve 86 |
|---|---|
| lower than −100 mm Hg | open |
| higher than −100 mm Hg | closed |

The meaning of "closed" and "open" is the same as that described with regard to the valve 80.

Various EGR characteristic curves of the system illustrated in FIG. 6A are obtained by selectively operating the valves 80, 82, 84 and 86 as indicated in the following table.

| Mode | valve 80 | valve 82 | valve 84 | valve 86 |
|---|---|---|---|---|
| (1) | open | open | open | open |
| (2) | open | X | closed | open |
| (3) | open | closed | open | open |
| (4) | closed | X | X | X |

In the mode (1), wherein all of the valves 80, 82, 84 and 86 are in the "open" condition, the system of FIG. 6A corresponds to the system of FIG. 1. Therefore, the EGR characteristic of this mode (1), which is shown by a curve I in FIG. 6B, corresponds to the curve composed of $A_1$, $A_2$, and $A_3$ in FIG. 3.

In the mode (2), wherein the valves 80 and 86 are open and the valve 84 is closed, the air chamber 50 of the modulator 38 is disconnected from the load sensing port 70 and is connected to the air filter 84. Therefore, the chamber 50 is always under a pressure near atmospheric pressure, even if the throttle valve **14*a* is opened above the port 70. Thus, the system of FIG. 6A in the mode (2) substantially corresponds to a known back pressure control type EGR system. As a result, the EGR ratio is, during the throttle opening of $\alpha$ to $\beta$, maintained at a constant value as shown by a characteristic curve II of FIG. 6B. In this case the speed of the introduction of air into the chamber 50, which corresponds to the value of the EGR ratio, is determined by the speed of air passing through the filter 84' and the third orifice 74, as well the flow rate of the air passing through the filter 52 and the fourth orifice 75**.

In the mode (3), wherein the valves 80, 84 and 86 are open and the valve 82 is closed, the vacuum line 72 does not serve to introduce atmospheric air into the chamber 50 of the modulator 38. However, the chamber 50 is always open to the atmosphere by the air filter 52. Thus, the system of FIG. 6A in the mode (3) corresponds to a known back pressure control type EGR system. Therefore, the EGR ratio is, during the throttle opening of $\alpha$ to $\beta$, maintained at a constant valve as shown by a characteristic curve III of FIG. 6B. Since air is introduced into the chamber 50 only through the filter 52 and the orifice 75, the rate of flow of air into the chamber 50 in this mode (3) is slower than the rate of flow of air in the mode (2). The EGR ratio in the mode (3) is higher than the EGR ratio in the mode (2).

In the mode (4) wherein the valve 80 is closed, the vacuum chamber 32 of the EGR valve 20 is always disconnected from the EGR port 36. Therefore, the valve member 26 is always seated on the valve seat 30 by the force of the spring 28, so that the EGR operation is not carried out.

The above-mentioned valves 80, 82, 84 and 86 may also be operated in accordance with the throttle opening, as illustrated hereinbelow.

(a) The first signal valve 80 is operated as indicated in the following table in accordance with the throttle opening.

| Throttle Opening $\theta$ (degree) | Valve 80 |
|---|---|
| $\theta < \alpha$ | open |
| $\theta > \alpha$ | closed |

Note: The other valves 82, 84 and 86 are always maintained open.

Note: The other valves 82, 84 and 86 are always maintained open.

Figure 6B:
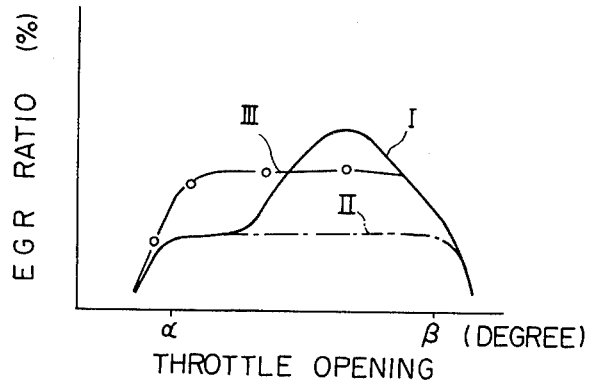
FIG. 6B is graphs showing various EGR characteristic curves obtained by the system in FIG. 6A.
Figures 1, 7:
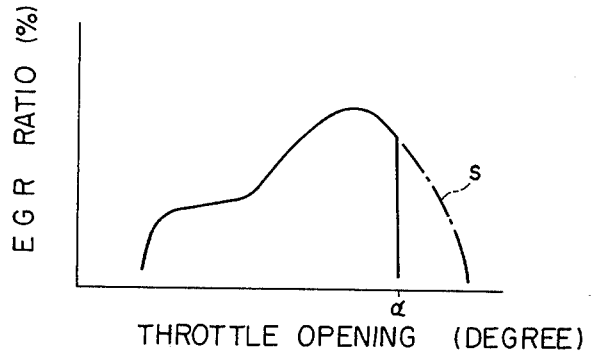
Figures 2, 7:
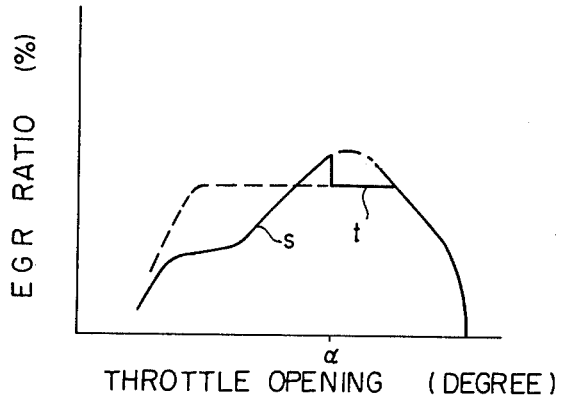
Figures 3, 7:
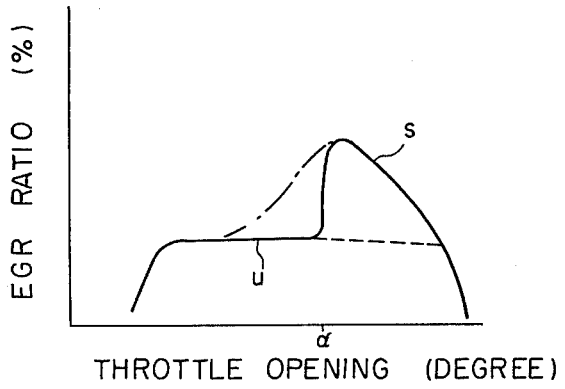
Figures 4, 7:
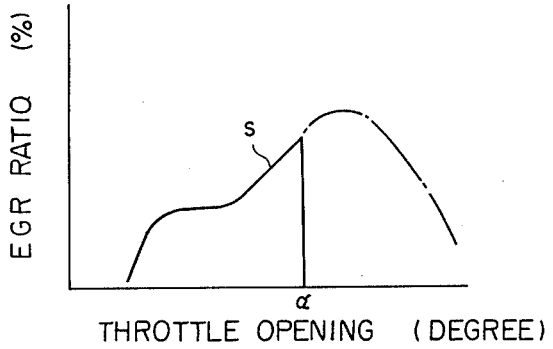
Figures 5, 7:
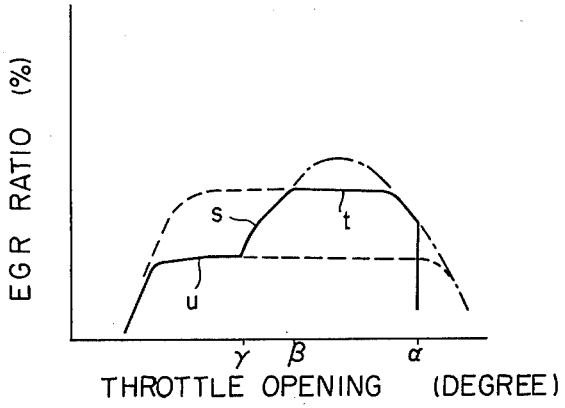

In this case, an EGR characteristic curve as shown by a solid line in FIG. 7-1 is obtained. When the throttle opening is larger than $\alpha$, a vacuum signal is not introduced into the vacuum chamber 32 of the EGR valve 20 due to the closed condition of the valve 80, causing the EGR operation to be stopped. The dotted curve s corresponds to the basic EGR characteristic curve I of the present invention shown in FIG. 6B.

(b) The second signal valve 82 is, operated as indicated in the following table.

| Throttle Opening $\theta$ | Valve 82 |
|---|---|
| $\theta < \alpha$ | open |
| $\theta > \alpha$ | closed |

Note: The other valves 80, 84 and 86 are always maintained open.

Note: The other valves 80, 84 and 86 are always maintained open.

Figure 2:
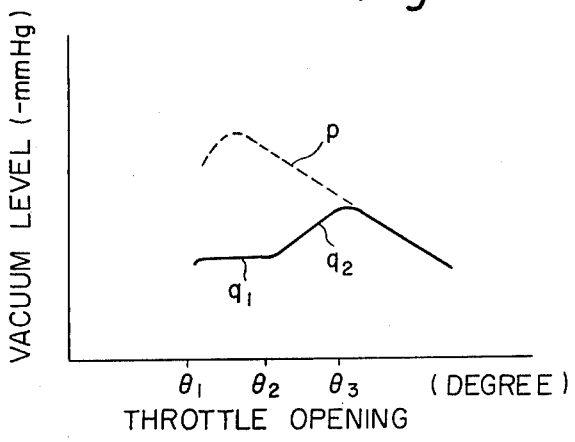
FIG. 2 is graphs showing relations between the throttle opening and the vacuum level, wherein the solid line indicates the vacuum lever at the EGR valve 20 while the dotted line indicates the vacuum level at the EGR port 36.

In this mode, the EGR characteristic curve, when the throttle opening is smaller than $\alpha$, is shown by a curve s in FIG. 7-2, which corresponds to the curve I in FIG. 6B. When the throttle opening is larger than $\alpha$, the EGR characteristic curve is shown by a curve t, which corresponds to the prior art EGR characteristic curve III in FIG. 6B.

(c) The third valve is operated as indicated in the following table.

| Throttle Opening $\theta$ (degree) | Valve 84 |
|---|---|
| $\theta < \alpha$ | closed |
| $\theta > \alpha$ | open |

Note: The other valves 80, 82 and 86 are always maintained open.

Note: The other valves 80, 82 and 86 are always maintained open.

In this mode, EGR characteristic curve, when the throttle opening is smaller than $\alpha$, is shown by a curve u in FIG. 7-3, which corresponds to the curve II in FIG. 6B. When the throttle opening is larger than $\alpha$, the EGR characteristic curve is shown by a curve s, which correspond to the EGR characteristic curve I of the present invention shown in FIG. 6B.

(d) The fourth signal valve 86 is operated as indicated in the following table.

| Throttle Opening $\theta$ (degree) | Valve 86 |
|---|---|
| $\theta < \alpha$ | open |
| $\theta > \alpha$ | closed |

Note: The other valves 80, 82 and 84 are always open.

Note: The other valves 80, 82 and 84 are always open.

In this condition, the EGR characteristic curve when the throttle opening is smaller than $\alpha$ is shown by a curve s in FIG. 7-4 which corresponds to the EGR characteristic curve I of the present invention shown in FIG. 6B. When the throttle opening is larger than $\alpha$, the EGR operation is stopped, since the EGR port 36 is disconnected from the vacuum chamber 32 of the flow control valve 20.

(e) The valves 80, 82 and 84 are operated as indicated in the following table.

| Throttle Opening $\theta$ (degree) | Valve 80 | Valve 82 | Valve 84 |
|---|---|---|---|
| $\theta < \alpha$ | open | open | closed |
| $\alpha < \theta < \beta$ | open | open | open |
| $\beta < \theta < \alpha$ | open | closed | open |
| $\theta > \alpha$ | closed | closed | open |

Note: The fourth valve 86 is always open.

Note: The fourth valve 86 is always open.

In this mode, the EGR characteristic curve when the throttle opening is smaller than $\gamma$ degree is shown by a curve u in FIG. 7-5, which corresponds to the prior art EGR characteristic curve II in FIG. 6B. When the throttle opening is located between $\gamma$ and $\beta$, the EGR characteristic curve is shown by a curve s in FIG. 7-5, which corresponds to the curve I in FIG. 6B. When the throttle opening is located between $\beta$ and $\alpha$, the EGR characteristic curve is shown by a curve t, which corresponds to the curve III in FIG. 6B. When the throttle opening is larger than $\alpha$ the EGR operation is stopped.

Figure 8:
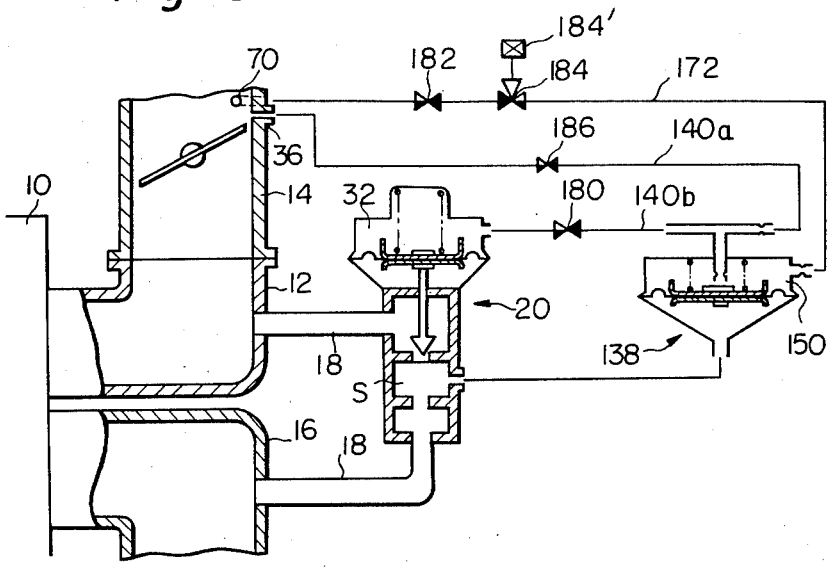
FIG. 8 illustrates a back pressure control type EGR system in another embodiment of the present invention.

Another embodiment, which is illustrated in FIG. 8, is substantially the same as the embodiment illustrated in FIG. 6A, except that a vacuum modulator 138 is not provided with any parts which correspond to the air filter 52 and the orifice 75 in FIG. 6A. Therefore, introduction of air into the an air chamber 150 of a modulator 138 is effected only by a vacuum line 172, which is connected to an air filter 184' via a three-port valve 184. The system illustrated in FIG. 8 may be operated as described hereinbelow.

(a) In a first mode of operation, a signal control valve 180 located on a vacuum line **140*b*** is switched between an open condition and a closed condition, as illustrated in the following table.

| Throttle Opening $\theta$ | Valve 180 |
|---|---|
| $\theta < \alpha$ | closed |
| $\alpha < \theta < \beta$ | open |
| $\theta > \beta$ | closed |

Note: The other valves 182, 184 and 186 are always open.

Note: The other valves 182, 184 and 186 are always open.

Figures 1, 9:
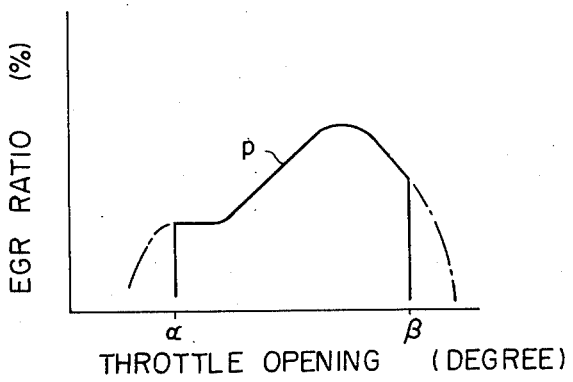
Figures 2, 9:
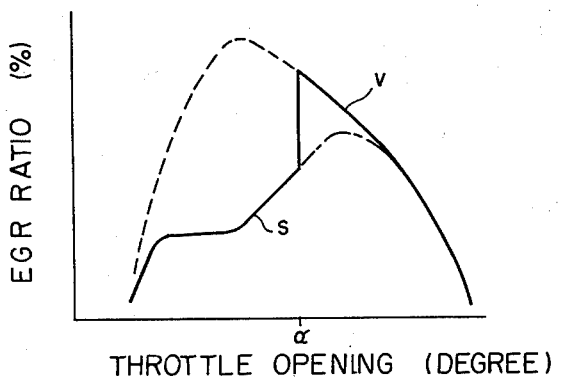
Figures 3, 9:
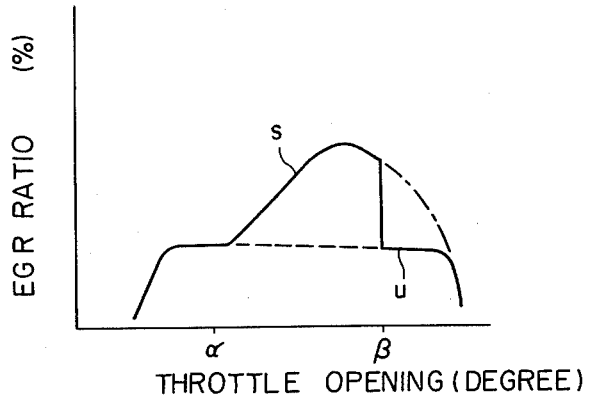
Figures 4, 9:
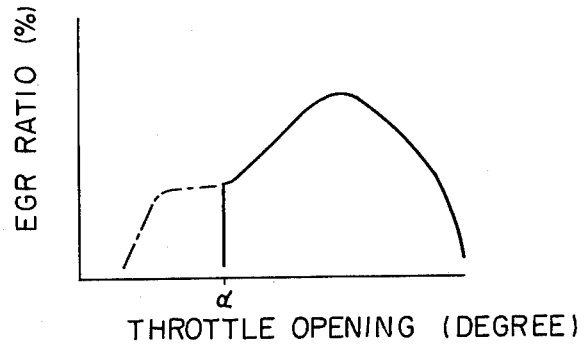

When the throttle opening is smaller than $\alpha$ degree or is larger than $\beta$ degree, a vacuum signal is not transmitted into the flow control valve 20, causing the EGR operation not to be carried out, as shown in FIG. 9-1. When the throttle opening is in a range of $\alpha \sim \beta$, the system of FIG. 8 substantially conforms to the system of FIG. 1, except that the filter 52 and the orifice 75 are not provided. Thus, the EGR characteristic curve in this range of throttle opening $\alpha \sim \beta$, which is shown by a curve s in FIG. 9-1, substantially conforms to the curve I in FIG. 6B.

(b) In a second mode of operation, a second signal control valve 182 is operated as indicated in the following table.

| Throttle Opening | Valve 182 |
|---|---|
| $\theta < \alpha$ | open |
| $\theta > \alpha$ | closed |

Note: The other valves 180, 184 and 186 are always open.

Note: The other valves 180, 184 and 186 are always open.

In this case, when the throttle opening is smaller than $\alpha$ the EGR characteristic curve is shown by a curve s in FIG. 9-2, which corresponds to the basic EGR characteristic curve of the present invention. When the throttle opening is larger than $\alpha$, the chamber 150 of the modulator is always disconnected from the atmosphere. Therefore, the vacuum level in the chamber 32 of the EGR value conforms to the vacuum level at the EGR port 36, as shown by the curve p in FIG. 2. The EGR characteristic curve at the throttle opening larger than $\alpha$ is shown by a curve v, which corresponds to an EGR characteristic curve of a so-called vacuum control type EGR system.

(c) In the third mode of the operation, the third valve 184 is operated as indicated in the following table.

| Throttle Opening | Valve 184 |
|---|---|
| $\theta < \alpha$ | closed |
| $\alpha < \theta < \beta$ | open |
| $\theta > \beta$ | closed |

Note: The other valves 180, 182 and 186 are open.

Note: The other valves 180, 182 and 186 are open.

When the throttle opening is smaller than $\alpha$ or larger than $\beta$, the chamber 150 of the modulator 138 is connected to the atmosphere via the conduit 172, the valve 184 and the air filter 184'. In such a case, the EGR characteristic curve is as shown by u in FIG. 9-3 which corresponds to the curve of the known proportional type EGR system. When the throttle opening is between $\alpha \sim \beta$, the EGR characteristic curve is as shown by s in FIG. 9-3, which corresponds to the EGR characteristic curve of the present invention.

(d) In he fourth mode of the operation, the valve 186 is operated as indicated in the following table.

| Throttle Opening | Valve |
|---|---|
| $\theta < \alpha$ | closed |
| $\theta > \beta$ | open |

Note: The other valves are always open.

Note: The other valves are always open.

In this operational mode, the EGR operation is stopped when the throttle opening is smaller than $\alpha$, as shown in FIG. 9-4.

While the present invention has been described with reference to the accompanied drawings, many modifications and changes may be made by those skilled in this art without departing from the scope of the present invention.

What is claimed is:

1. An exhaust gas recirculation system of an internal combustion engine having an engine body, an intake device connected to the engine body, a throttle valve arranged in the intake device, and an exhaust device connected to the engine body, said system comprising:

passageways means connecting the exhaust device with the intake device for recirculating a part of exhaust gas from the exhaust device to the intake device;

flow control valve means arranged in said passageway means and having vacuum actuator means for controlling the opening of the valve means;

vacuum conduit means connecting the vacuum actuator means with a first vacuum source formed in said intake device at a position slightly upstream of the throttle valve in its idle condition, the throttle valve engaging with the first vacuum source when the opening of the throttle valve is larger than a predetermined degree;

means for forming a space of predetermined small volume in said passageway means at a position located between the flow control valve means and the exhaust device;

modulator means having a control chamber which is, in accordance with the pressure of the exhaust gas in said space, selectively opened to said vacuum conduit means for controlling the vacuum level in said vacuum actuator means, and;

second vacuum conduit means connecting the control chamber with a second vacuum source in said intake device at a position slightly upstream of the first vacuum source, the throttle valve engaging with the second vacuum source when the opening of the throttle valve is larger than the predetermined degree.

2. An exhaust gas recirculation system according to claim 1, wherein said first signal conduit means has a first orifice means, said modulator means has a second orifice means, and said second signal conduit means has a third orifice means, the dimensions of the first, second and third orifice means being so determined that a predetermined EGR characteristic curve is obtained.

3. An exhaust gas recirculation system according to claim 1, wherein said first signal conduit means has a first orifice means, said modulator means has a second orifice means, said second signal conduit means has a third orifice means, said modulator means further has a fourth orifice means for connecting the control chamber with the atmosphere, the dimension of the first, second, third and fourth orifice means being so determined that a predetermined EGR characteristic curve is obtained.

4. An exhaust gas recirculation system according to claim 1, wherein said second vacuum source comprises a plurality of vacuum ports formed in the intake device.

5. An exhaust gas recirculation system according to claim 1, wherein said first vacuum conduit means is provided with at least one switching valve responsive to a particular engine operating parameter for selectively disconnecting the first vacuum source from the flow control valve means for stopping the EGR operation.

6. An exhaust gas recirculation apparatus according to claim 1, wherein said second vacuum conduit means is provided with a switching valve which is responsive to an engine operating parameter for selectively disconnecting the second vacuum source from the control chamber of the modulator.

7. An exhaust gas recirculation system according to claim 1, wherein said second vacuum conduit is provided with a valve responsive to an engine operating parameter, which is switched between a first position wherein the control chamber of the modulator communicates with the second vacuum source and a second position wherein the control chamber communicates with the atmosphere.

* * * * *

UNITED STATES PATENT AND TRADEMARK OFFICE

CERTIFICATE OF CORRECTION

PATENT NO. : 4,222,355

DATED : Sept. 16, 1980

INVENTOR(S) : Yamasaki et al.

It is certified that error appears in the above—identified patent and that said Letters Patent is hereby corrected as shown below:

Col. 2, line 9, change "lever" to --level--.

Col. 4, line 58, change "FGB" to --FGR--.

Col. 5, line 24, change "36" to --26--.

Col. 5, line 48, change "fource" to -- fourth --.

Col. 11, line 7, change "he" to --the--.

Col. 11, line 31, change "passageways" to --passageway--.

Signed and Sealed this

*Thirteenth* Day of *January 1981*

[SEAL]

*Attest:*

SIDNEY A. DIAMOND

*Attesting Officer*

*Commissioner of Patents and Trademar*